US006137091A

United States Patent [19]

Kikuoka et al.

[11] Patent Number: 6,137,091

[45] Date of Patent: Oct. 24, 2000

[54] ELECTRIC COOKER

[75] Inventors: Mitsuhiko Kikuoka; Satoru Shibata, both of Kyoto, Japan

[73] Assignee: Matsushita Electric Industrial Co., Ltd., Osaka, Japan

[21] Appl. No.: 09/355,238

[22] PCT Filed: Nov. 18, 1998

[86] PCT No.: PCT/JP98/05187

§ 371 Date: Jul. 26, 1999

§ 102(e) Date: Jul. 26, 1999

[87] PCT Pub. No.: WO99/27306

PCT Pub. Date: Jun. 3, 1999

[30] Foreign Application Priority Data

Nov. 25, 1997 [JP] Japan ..... 9-322597

[51] Int. Cl.[7] ..... H05B 1/02

[52] U.S. Cl. ..... 219/501; 219/519; 219/481; 219/486; 324/418; 361/160

[58] Field of Search ..... 219/519, 481, 219/494, 508–510, 497, 485, 486, 501; 361/13, 8, 187, 31, 6, 7; 324/418, 537, 424

[56] References Cited

U.S. PATENT DOCUMENTS 4,389,691 6/1983 Hancock ..... 361/8
4,959,746 9/1990 Hongel ..... 361/13
5,243,291 9/1993 Umemura ..... 324/418

FOREIGN PATENT DOCUMENTS 55-82314 6/1980 Japan .
63-64231 3/1988 Japan .
3-89425 4/1991 Japan .
58-40674 9/1991 Japan .
5-307991 11/1993 Japan .
9-185932 7/1997 Japan .
9-293440 11/1997 Japan .

OTHER PUBLICATIONS

Int'l Search Report for Int'l Appln No. PCT/JP98/05187 dated Feb. 16, 1999.
English translation of Form PCT/ISA/210.

*Primary Examiner*—Mark Paschall
*Attorney, Agent, or Firm*—Ratner & Prestia

[57] ABSTRACT

Due to a bimetallic contact point, a fine control is out of sight. Further, dispersion of bimetal characteristics and poor durability of a contact point cause problems, particularly in maintenance work. In order to overcome these problems, a controller for extending a service life of the contact point can provide a fine control, so that a maintenance-free electric cooker can be provided. The ON/OFF of the contact point of relay is controlled to operate at zero potential of commercial power, and a short-pulse-signal-switch that allows the relays to remove deposition by itself even if the contact point encounters deposition, are prepared and applied to plural heaters for controlling thereof.

5 Claims, 9 Drawing Sheets

ELECTRIC COOKER

This application is a U.S. National Phase application of PCT international application PCT/JP98/05187.

TECHNICAL FIELD

The present invention relates to a heat-adjustable electric cooker employing a plurality of heaters.

BACKGROUND ART

FIG. 9 shows a structure of a generally known heat-adjustable electric cooker employing a plurality of heaters.

In FIG. 9, the cooker comprises heaters 31 and 38, heat-adjuster 32 and 39 employing bimetal for adjusting heat, commercial power 33, warning lamp 34 for indicating the heater is ON, switches 35 and 40 incorporated in the heat-adjuster, bimetallic switches 36 and 41 on a control side, sub-heaters 37 and 42 for heating the bimetal and being connected to heaters 31 and 38 in series. Sub-heaters 37 and 42 are incorporated into switches 36 and 41 on the control side.

Heat of this electric cooker is adjusted in this way: bimetallic switches 36 and 41 are heated by sub-heaters 37 and 42, and the switches 36 and 41 interlock switches 35 and 40 to open or close thereof.

The conventional construction employing bimetal has the following problems: (a) a wide range of performance dispersion of bimetal in respective products are expected, (b) various types of bimetal responsive to wattage of respective heaters must be prepared in order to minimize the difference in heat value, (c) and thus fine controlling is needed, (d) a great amount of heat dissipation is wasted due to a long control duty (e) heat is applied to food with low efficiency, (f) from the view point of service life of the electric cooker, contact points must be replaced periodically due to insufficient durability, and (g) in a case of a large size appliance such as built-in type cooker in a system kitchen, a large number of heaters make the replacement cumbersome and time-consuming work, which produces serious problems in maintenance.

DISCLOSURE OF THE INVENTION

The present invention addresses the problems discussed above, and the first object is to provide an electric cooker having the following advantages: stable performance can be expected in each product, a product free from being matched with a heater, and a product having a contact point of excellent durability and expecting easy replacement or maintenance-free.

The second object is to provide an electric cooker having a controller that can reduce the chances of forming deposition on contact points of relay.

The third object is to provide an electric cooker that can heat food efficiently and perform fine control over the heat.

The fourth object is to provide an electric cooker that can forcibly halt the operation of the cooker when the contact point issues a maintenance warning or shows its end of service life so that safety of the cooker can be ensured.

The fifth object is to provide an electric cooker that has an inexpensive memory storing the safety status before a power failure.

The electric cooker of the present invention comprising the following elements:

- a plurality of heaters;
- a plurality of relays for controlling the heaters at their contact points;
- a deposition detector for detecting deposition at each contact point;
- a controller for switching a relay control signal into a short pulse signal based on a signal from the detector when the contact point is deposited;
- a heat-adjuster for adjusting the heat of respective heaters and inputting the signals to the controller.

The controller controls the plurality of relays based on a signal from 0 (zero) volt-detector. The signal is used for ON/OFF the contact points at near 0 (zero) potential. The controller also controls the heat of the respective heaters. Since the controls of ON/OFF of relays and the heat at the plurality of heaters are practiced based on the signal from a zero-volt-detector, stable and reliable control can be practiced for a long time.

The electric cooker of the present invention includes a polarity switch that controls ON/OFF of the contact point by using the transition points from/to negative area to/from positive area of the commercial power based on a signal from the deposition detector that detects deposition on the respective ends of the contact points. The positive and negative potentials of an alternating current can be used for ON/OFF the contact point, the deposition on contact points can be thus restrained, and therefore the service life of the contact point can be substantially extended.

The electric cooker of the present invention includes an automatic cycle switch that switches a plurality of control cycles in the heat-adjustment process, and it also includes a manual low-heat-selector. This manual selector only functions at a given period in the heat-adjustment process. A low heat control switch has an automatic canceler that cancels automatically the low heat when the given period is over. Heat-adjusting cycles are thus automatically switched responsive to the heat to reduce wasteful heat dissipation. In addition, when the heat is set somewhere between "high" (HMD) and "low" (LOW), the heat control cycle can be further shortened by the low-heat-selector so that fine heat adjustment can be realized.

The electric cooker of the present invention includes a calculation processing section (CPS) that processes two kinds of data. One is data counted by a counter which counts a number of short pulse signals from the controller, and another is ON/OFF data of the contact points from the deposition detector. The cooker also includes a determiner that issues a warning or forcibly halts the cooker to operate based on a calculation result by the CPS. Degrading state of the contact points can be monitored by the calculation of the short-pulse-signals generated from the controller and the signal data from the deposition detector in the CPS. A warning or a forced halt is issued responsive to the calculation results. This structure allows the cooker to give a maintenance warning, and to forcibly halt the operation before the contact points encounter locking or light deposition even if a user continues using the cooker without noticing the warnings.

The electric cooker of the present invention includes a memory utilizing electric charges of the capacitors which hold a forced-halt-signal or a warning signal issued by the determiner. The status where a forced-halt-signal has been issued can be stored in this memory even the cooker encounters an abrupt voltage drop, a power failure, or a power-off by error, so that the safety of the cooker can be ensured.

BRIEF DESCRIPTION OF THE DRAWINGS

FIG. 4(*b*) illustrates operation characteristics of the knob.

DETAILED DESCRIPTION OF A PREFERRED EMBODIMENT

A preferred embodiment of the present invention is described hereinafter with reference to the accompanying drawings.

Figure 1:
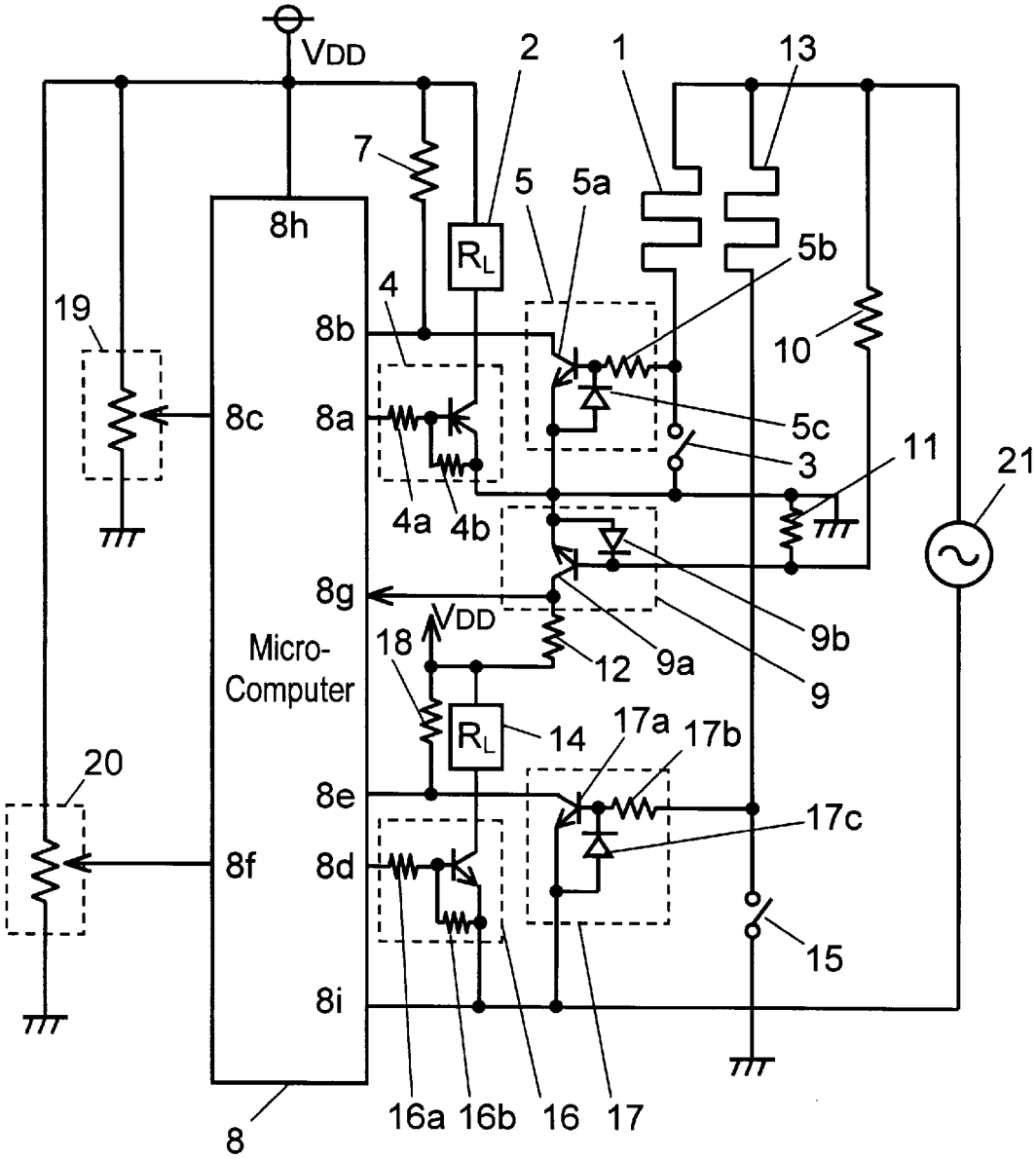
FIG. 1 is a circuit diagram of an electric cooker in accordance with an exemplary embodiment of the present invention.

FIG. 1 shows a construction of an electric cooker having two burners. As shown in FIG. 1, the electric cooker comprises the following elements denoted with reference numbers:

first heater 1;

first relay 2;

contact point 3 of first relay 2;

transistor 4 for driving first relay 2, transistor 4 has a built-in resistor and comprises built-in base resistor 4*a* and built-in resistor 4*b* between the base and emitter;

first deposition detector 5 for detecting deposition at contact point 3;

pull-up resistor 7 for pulling up an output of detector 5; first deposition detector 5 comprises transistor 5*a*, resistor 5*b* for limiting a base current, diode 5*c* for protecting a reverse voltage between the base and emitter, controller 8, a micro-computer is employed in this embodiment;

detector 9 for detecting zero volt in the commercial power; detector 9 detects the zero volt with transistor 9*a* to which the voltage of the commercial power divided by resistors 10 and 11 is applied, diode 9*b* for protecting a reverse voltage of transistor 9*a*;

pull-up resistor 12 for pulling up an output from the zero-volt-detector 9;

second heater 13;

second relay 14;

contact point 15 of second relay 14;

transistor 16 for driving second relay 14, transistor 16 has a built-in resistor and comprises built-in base resistor 16*a* and built-in resistor 16*b* between base and emitter;

second deposition detector 17 for detecting deposition at contact point 15;

pull-up resistor 18 for pulling up an output of detector 17; second deposition detector 17 comprises transistor 17*a*, resistor 17*b* for limiting a base current, diode 17*c* for protecting a reverse voltage between the base and emitter, first heat adjuster 19 and second heat adjuster 20 for controlling the heat of first and second heaters, these adjusters comprise variable resistors; and commercial power 21.

First and second relays 2, 14 are not shown in FIG. 1; however, they are buries together in a control panel of the cooker in a replaceable manner so that the two relays can be replaced together or independently. They can be replaced in a simple way without moving the cooker.

The relays can be buried not only in the control panel but also in a side panel or in a top panel in the same manner, or the relays can be buried in a place close to an enclosure of the cooker with the same effect.

The relays are buried with some lock mechanism or in a manner requiring some special tool for replacement so that children or persons unfamiliar with the replacement cannot open or disassemble the panel.

An operation in accordance with the embodiment is described hereinafter with reference to FIG. 1.

When a signal for driving first relay is tapped off from relay-driving output 8*a* of micro-computer 8, transistor 4 turns to ON and drives first relay 2 to close contact point 3, thereby powering first heater 1. A voltage (divided voltage) determined by a rotation angle of a variable resistor at heat adjuster 19 is fed into input section 8*c* of an AD converter of micro-computer 8. A relay control signal undergone duty control is tapped off from output 8*a*. This relay control signal is also controlled such that the contact point can be ON/OFF near zero potential based on input 8*g* from zero-volt-detector 9 and input 8*b* from first deposition detector 5 (doubling the functions of deposition detector and ON/OFF detector of contact point.) Zero-volt detection is obtained by the voltage of the commercial power 21 divided by resistors 10 and 11. Second heater 13 is controlled based on the input/output 8*d*, 8*e* and 8*f* of micro-computer 8. The heat of second heater 13 is determined by an operation duty of second relay 14 adjusted by second heat adjuster 20.

An operation of first deposition detector 5 is hereinafter described.

In a case that relay-driving-output 8*a* is OFF but contact point 3 of first relay 2 does not turn to OFF, since the base and emitter of transistor 5*a* at deposition detector 5 are shorted by the contact point, transistor 5*a* turns to OFF. A deposition-detection-signal in HI level is fed into input 8*b* of microcomputer 8 by pull-up resistor 7. Then micro-computer 8 determines that a deposition occurs. Deposition on the contact point of second relay 14 occurs in the same way; thus the description is omitted.

An operation when the contact point encounters deposition is described with reference to the timing-chart in FIG. 2.

Figure 2:
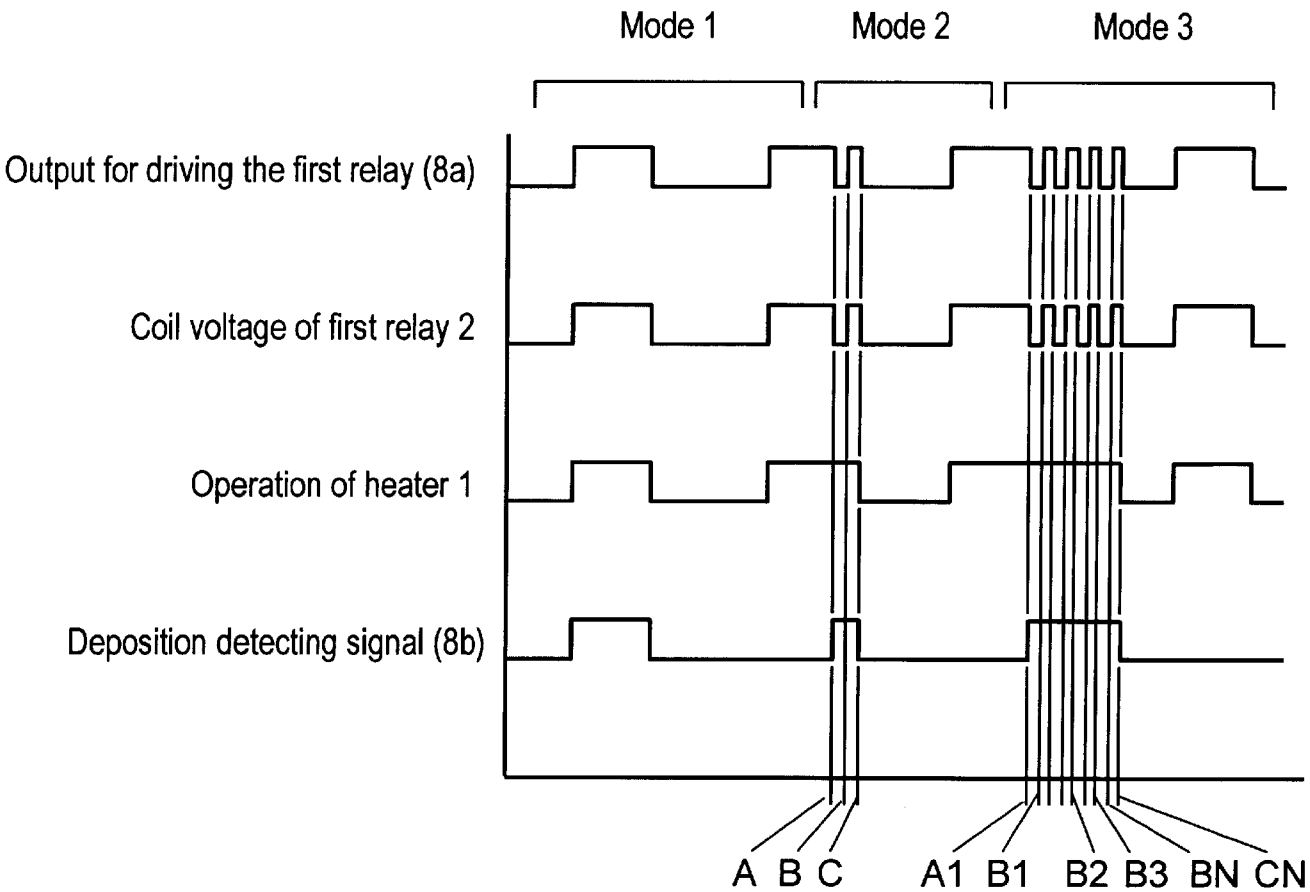
FIG. 2 illustrates a sequential canceling operation of deposition on a contact point of a relay in accordance with the exemplary embodiment.

Mode 1 in FIG. 2 shows a normal operation of the relay, namely, relay-driving-output 8*a* drives first relay 2 with transistor 4 having a built-in resistor. If a motion delay of relay 2 is neglected, the operation of first heater 1 can be shown by the same signal waveform. Output 8*a* of micro-computer 8 is thus considered straightly an operation time of first heater 1.

Mode 2 where the contact point encounters deposition is described with reference to FIG. 2. Output 8*a* changes to OFF from ON at point A, and at the same time, a coil voltage of first relay 2 turns to OFF. However, first heater 1 does not turn to OFF. When input 8*b* of microcomputer 8 receives a deposition-detection-signal, output 8*a* changes into a short pulse signal at point B. When the short pulse signal is imposed to a coil of first relay 2, contact point 3 receives an impact, which cancels the deposition at point C. Once the deposition is removed, the relay works normally and encounters a deposition less occasionally.

Mode 3 is described next, where deposition won't be cancelled with a single impact by short-pulse-signals.

When a single impact imposed to the contact point cannot remove the deposition, the deposition is detected at point A1, and relay-driving-output 8*a* gives a first impact to the contact point at point B1, though it fails to remove the deposition. Then the second impact pulse is imposed at point B2. If it fails again, another impact is given at point B3, and this operation is repeated until the deposition is removed at point BN.

As such, impact pulses are repeatedly imposed from microcomputer 8 to the contact point until the deposition is removed, then the deposition is cancelled at point CN, and the operation thus returns to the normal sequence.

If the relay were to be locked due to the deposition, a signal controlled by the relay is changed to a short pulse signal, which impacts against the deposited contact point thereby removing the deposition. This self-removing function of the relay can substantially extend a service life of the contact point that controls the heater. As a result, maintenance work of removing the deposition can be substantially reduced.

Further, if the deposition were not removed with a given number of impact pulses, the cooker issues a warning signal that allows a controller to discontinue the power, or the warning signal notices a nearby person of the situation, whereby the safety of the cooker is ensured.

Figure 3:
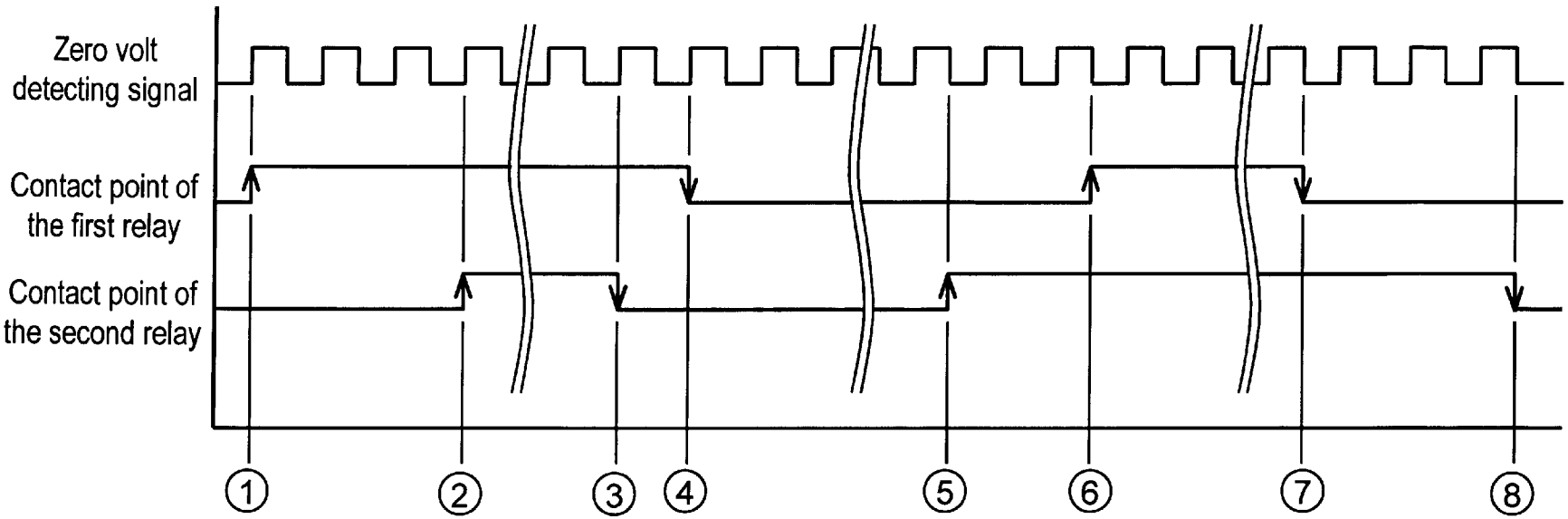
FIG. 3 illustrates a sequential operation of the contact points of the relay in accordance with the exemplary embodiment.

The timing chart in FIG. 3 illustrates time-shared-control on the two relays in a sequential manner and simultaneous control over ON/OFF of the contact point alternately corresponding to transition point from/to positive area to/from negative area at zero potential of commercial power.

The upper section of FIG. 3 shows an output waveform of zero-volt-detector 9, which has been transformed from commercial power 21 through waveform shaping process. Zero potential point corresponds to an edge where the zero-volt-detection-signal changes. The following description is referred to the edge section.

The contact point of first relay 2 turns to ON at forward direction (from negative to positive) of commercial power 21, which is indicated at point ①. In the same manner, the contact point of second relay 14 turns ON at forward direction of commercial power 21 after three cycles of the zero-volt-detection signal, which is indicated at point ②. The contact point of second relay 14 turns to OFF also at forward direction, which is indicated at point ③. In the same manner, the contact point of first relay 2 turns to OFF at forward direction after three cycles, which is indicated at point ④.

However, an operation of the relay following the heretofore operation is different. The contact point of second relay 14 turns to ON at reverse direction (positive to negative), which is indicated at point ⑤. In the same manner, the contact point of first relay 2 turns to ON at reverse direction after three cycles, which is indicated at point ⑥. Point ⑦ indicates the OFF operation of first relay 2, and point ⑧ indicates the OFF operation of second relay 14. Both operations are practiced at reverse direction, and second relay 14 turns to OFF after three cycles.

Further, first and second heaters 1, 13 are desirably controlled at zero potential in a highly accurate manner, therefore, ON/OFF of two relays 2, 14 are controlled in a time-shift manner so that noise disturbance and interference with each other can be avoided. This control manner is programmed in microcomputer 8.

Arc-discharge during the operation of the contact point provides the metallic contact with thermal influence, for the arc-discharge occurs when large current runs even at a low voltage. This thermal influence permits the metal of one contact point to move to its counterpart, which produces hills and valleys between the two contact points. This not only degrades the contact but also sometimes permits both points not to be apart from each other because the hills engage with valleys (locking.) Since this metal moving phenomenon degrades durability of the contact points, this phenomenon is desirably prevented in order to strengthen the durability of the contact points of relays. In this embodiment, therefore, the contact points are controlled at zero-potential, and ON/OFF is controlled in such a manner to take the dispersion at the zero potential into consideration. In other words, when the contact point turns to ON/OFF at forward direction, then the next ON/OFF is practiced at reverse direction. The metal moving phenomenon is thus minimized.

An individual operation of respective relays is controlled in a time-shared manner, i.e. ON/OFF of respective contact points are time-shifted, whereby individual ON/OFF operation of respective contact points at zero potential can be accurately practiced. In other words, the microcomputer controls respective relays correctly, so that each contact point can be accurately controlled at zero-potential free from noise disturbance or interference with each other. As a result, stable ON/OFF operation of the contact points can be expected.

This embodiment shows the example of two burners; however, the present invention is not limited to this embodiment, but is applicable to an electric cooker having more than two burners.

An operation of an automatic cycle switch that switches a plurality of control cycles in heat-adjustment is described with reference to FIG. 4.

Figure 4A:
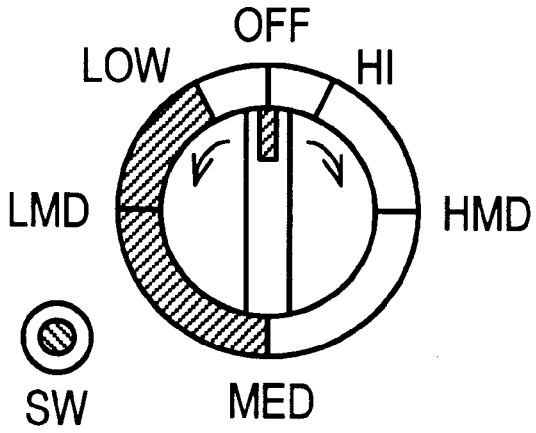
FIG. 4(*a*) shows a construction of a knob at heat-adjuster of the electric cooker in accordance with the exemplary embodiment.
Figure 4B:
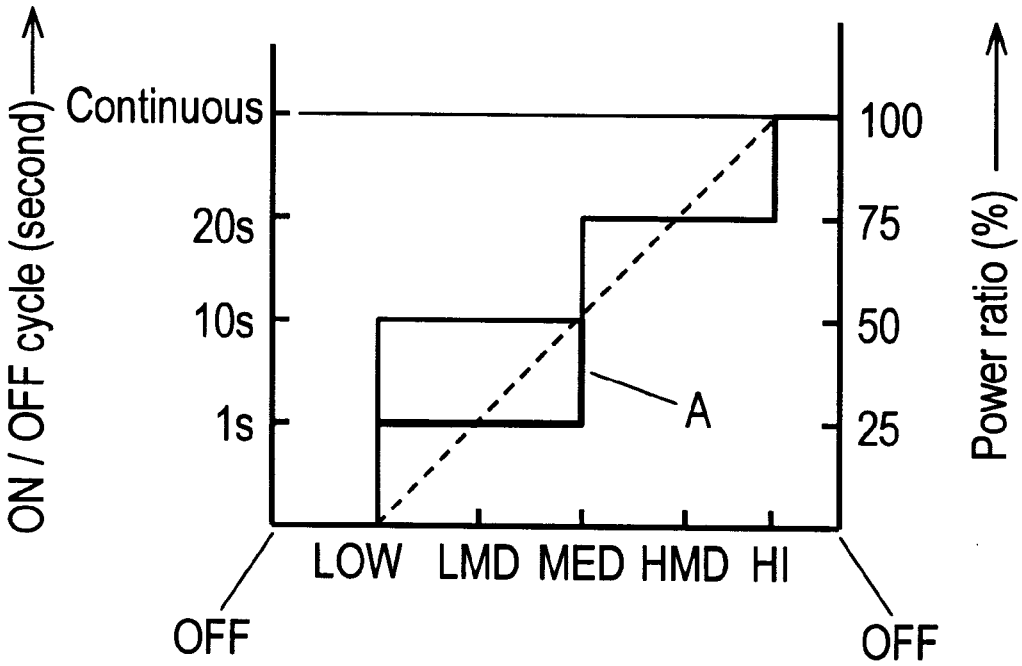

FIG. 4 shows a knob at the heat-adjuster of the electric cooker having two burners, and the graph in FIG. 4 illustrating the ON/OFF cycle responsive to the knob's rotation position and the power ratio under duty control.

FIG. 4(*a*) is a knob of the heat adjuster, which is at an OFF status. Clockwise rotation changes the heat responsive to the respective marks, i.e. HI (maximum heat in the continuous powered status), HMD (high heat in a high duty status), MED (medium heat in a medium duty status), LMD (lower medium heat in a lower medium duty status), and LOW (low heat in a low duty status). The knob can be rotated in a counterclockwise direction. FIG. 4(*b*) is a graph illustrating the knob positions, its corresponding open/close cycle (left-side scale) and power ratio (right-side scale.) The open/close cycle is set at 10 sec/cycle covering LOW to MED, and at 20 sec/cycle for MED to just before HI. At HI position, the heater is continuously powered.

The right-side scale indicates the power ratio responsive to the knob positions. As the bold line draws linear lines from LOW to HI, the power ratio changes linearly based on duty ratios corresponding to the knob positions.

Manual control of low heat selector effective only at a given part of the heat adjuster is described with reference to FIG. 5.

Figure 5:
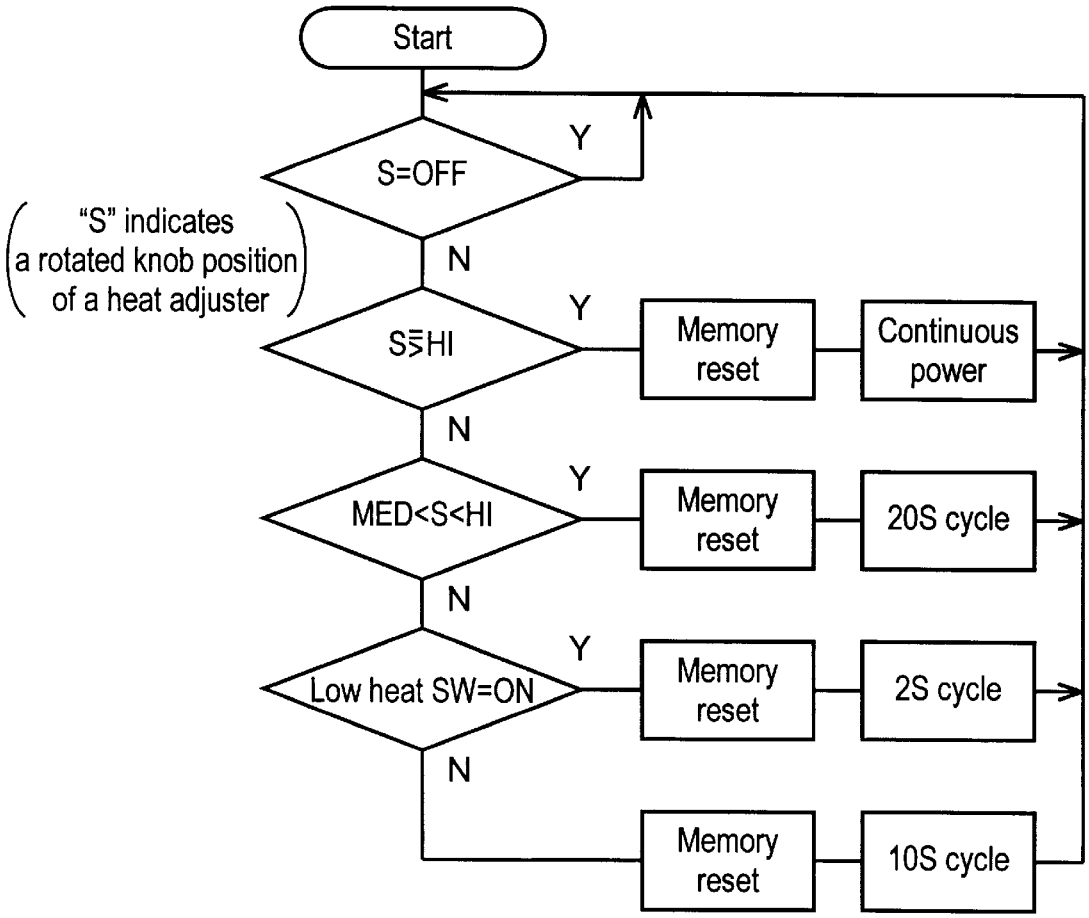
FIG. 5 is a flowchart of the heat-adjuster and a low-heat mode in accordance with the exemplary embodiment.

FIG. 5 is a flowchart, and "S" indicates a rotational position of the knob. First, when S=OFF is Y (YES), the heater stays in an OFF loop and is not powered. When S=HI or S>HI, the memory is reset and the heater is continuously powered. When MED<S<HI, the memory is reset and the heater is powered in 20 seconds/cycle. When an ON period takes 10 seconds out of 20 seconds, the power ratio is thus 50%.

When the low heat SW=ON is N (NO), the memory is reset and the heater is powered in 10 seconds/cycle. When S=ON is Y, the low heat SW is selected from the memory and the low heat SW makes a fine control in 2 seconds/cycle. If the power is discontinued by error, or a power failure occurs in this status, this condition is stored in the memory, and is to be practiced after the power is restored. If the knob is turned to the positions other than the low heat SW=ON, another loop is selected from the memory and is practiced, and the low heat SW selection is deleted from the memory.

Figure 6:
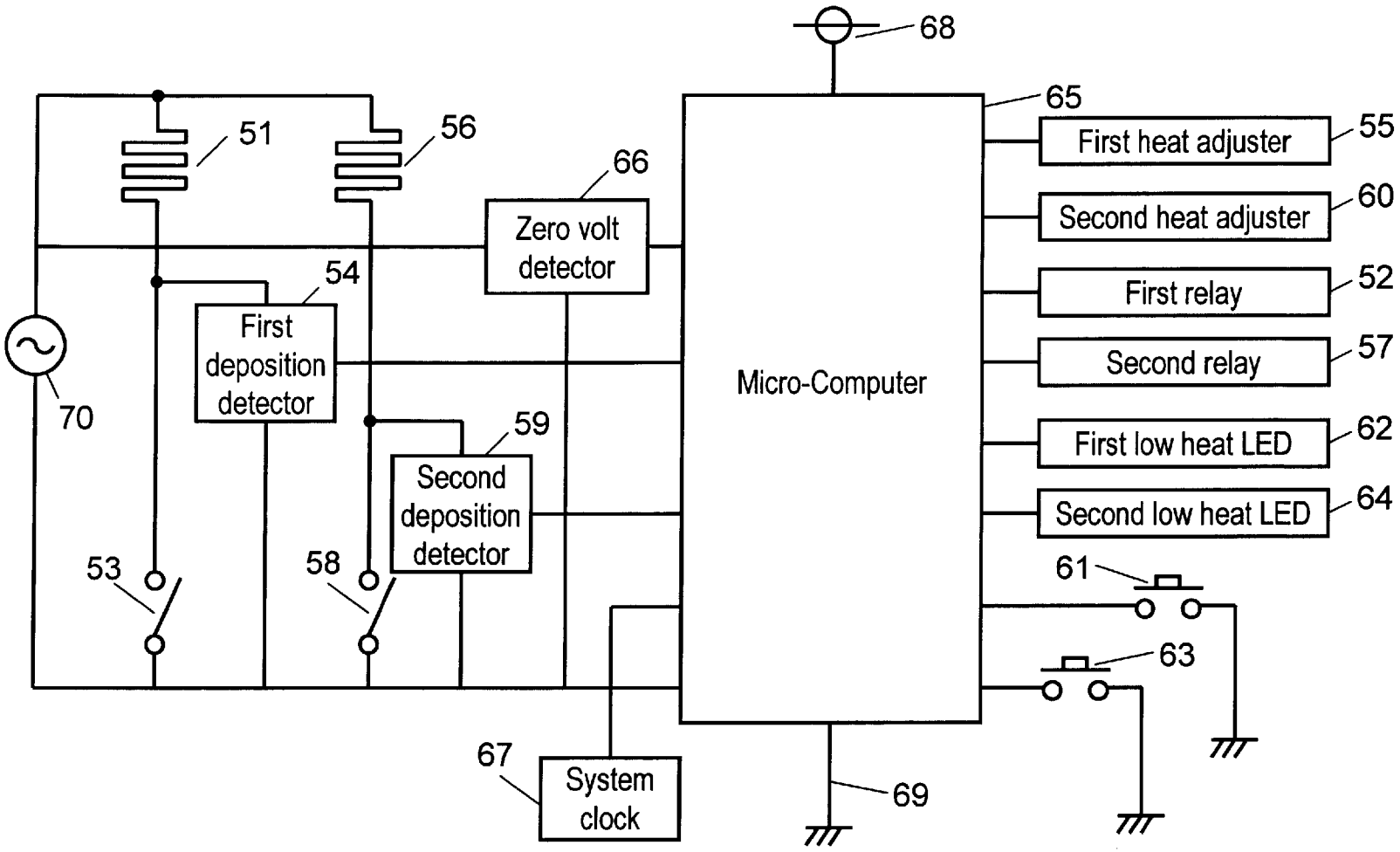
FIG. 6 is a block diagram of the heat-adjuster in accordance with the exemplary embodiment.

FIG. 6 shows a block diagram functioning as discussed above. In FIG. 6, the following elements with reference numbers are available:

first heater 51;

first relay 52 for controlling the first heater;

contact point 53 of the first relay;

first deposition detector 54 for detecting the condition of the contact point;

first heat adjuster 55 for adjusting heating power; as in the same manner as discussed above, another set is prepared as follows: i.e. second heater 56;

second relay 57;

contact point 58 of the second relay;

second deposition detector 59 for detecting the condition of the contact point;

second heat adjuster 60;

first low heat selection switch 61 effective only a given part of the first heat adjuster;

first low heat LED 62 indicating that the first low heat is selected;

second low heat selection switch 63 effective only a given part of the second heat adjuster;

second low heat LED 64 indicating that the second low heat is selected;

microcomputer 65 functions as a controller;

zero volt detector 66 for detecting the zero volt of commercial power in order to control the contact point of the relay at the zero volt;

system clock 67;

VDD 68 of dc power source;

VSS 69; and commercial power 70.

The construction discussed above allows the cooker to overcome the disadvantage, i.e. when rather low heat is used for cooking, an ON period is short and thus a greater heat amount is dissipated rather than used for cooking, which produces a poor efficiency of utilizing energy.

Figure 7:
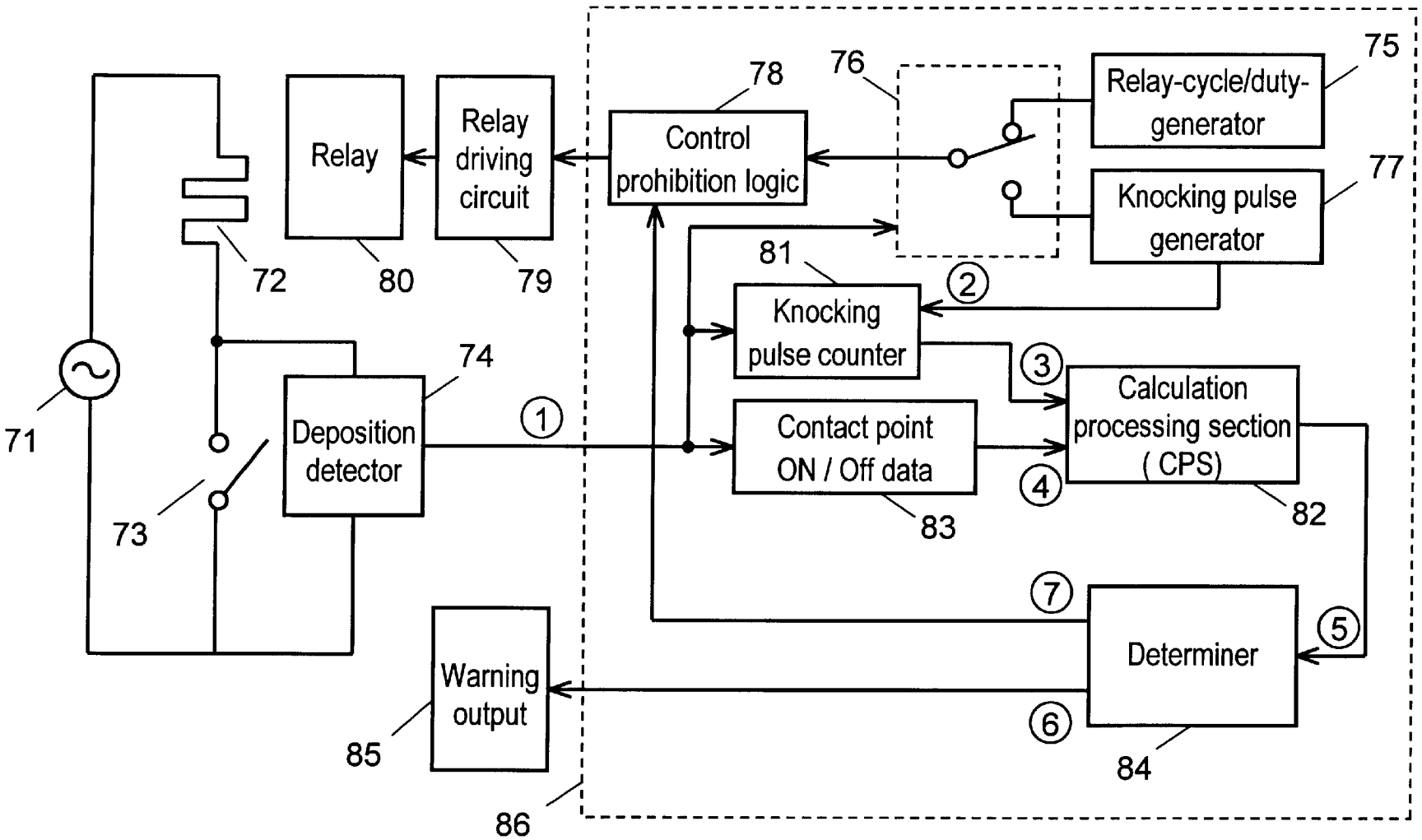
FIG. 7 is a block diagram of a deposition detector and a determiner in accordance with the exemplary embodiment.

When the contact point encounters deposition, the operations in the calculation processing section (CPS) and the determiner that halts forcibly the heating are described with reference to the block diagram in FIG. 7. In a closed circuit of the cooker including heater 72, contact point 73 and commercial power 71, deposition detectors 74 detecting the deposition are disposed at both the ends of the contact point. When an abnormality occurs at the contact point, the abnormality is dealt with through the following operation.

When the contact point encounters deposition and a contact-point-detection-signal runs through point ①, relay-cycle/duty-generator 75, which has normally worked, is changed to knocking-pulse-generator 77 by relay-coil-driving-signal-switch-circuit 76. The knocking pulse signal runs through control prohibition logic 78, then the signal is fed into relay-driving-circuit 79 where the signal changed to a short pulse signal, by which relay 80 is operated. As a result, the deposition on the contact point is removed by the relay itself. At this time, knocking pulse counter 81 starts to count a number of pulses when a knocking pulse runs through point ②, and counter 81 stops counting when the contact-point-deposition-signal is cancelled at point ①. The count data ③ is incorporated into a calculation of CPS 82. After the deposition is removed, deposition detector 74 changes its function as detecting ON/OFF data of the contact point. Delay time data 83 of the contact point with regard to the relay driving ON/OFF signals are converted into data code by contact-point ON/OFF data 83. Then, the output ③ of the knocking-pulse-counter and the data ④ of the contact point ON/OFF data are calculated in CPS 82 by the following equation, and the result ⑤ is compared with a given value X ($X_A$, $X_B$) in determiner 84, and the two results ⑥ and ⑦ are output.

Calculation equation:

$$\text{contact point ON/OFF data}/T \times \text{numbers of knocking pulse} \geqq X,$$

where:

$X_A$: determination standard of result ⑥

$X_B$: determination standard of result ⑦

T: time constant.

Output ⑥ drives warning output 85 which requests maintenance, and output ⑦ indicates the worse result, i.e. the contact point is close to the end of its service life. At this time, a STOP signal is provided to control-prohibition-logic 78 so that relay 80 is forcibly halted. Block 86 drawn with broken lines represents a microcomputer functioning as a controller in this embodiment.

Using a number of short pulses and ON/OFF data of the contact point, the computation discussed above figures out when the contact point reaches to the end of its service life. In the meanwhile, the short pulses can remove the deposition that is apt to occur when the contact point is close to its life end. Since the life end of the contact point can be thus predicted, a maintenance warning can be appropriately issued, or the electric cooker can be forcibly halted, whereby the safety of the electric cooker is substantially improved.

Figure 8:
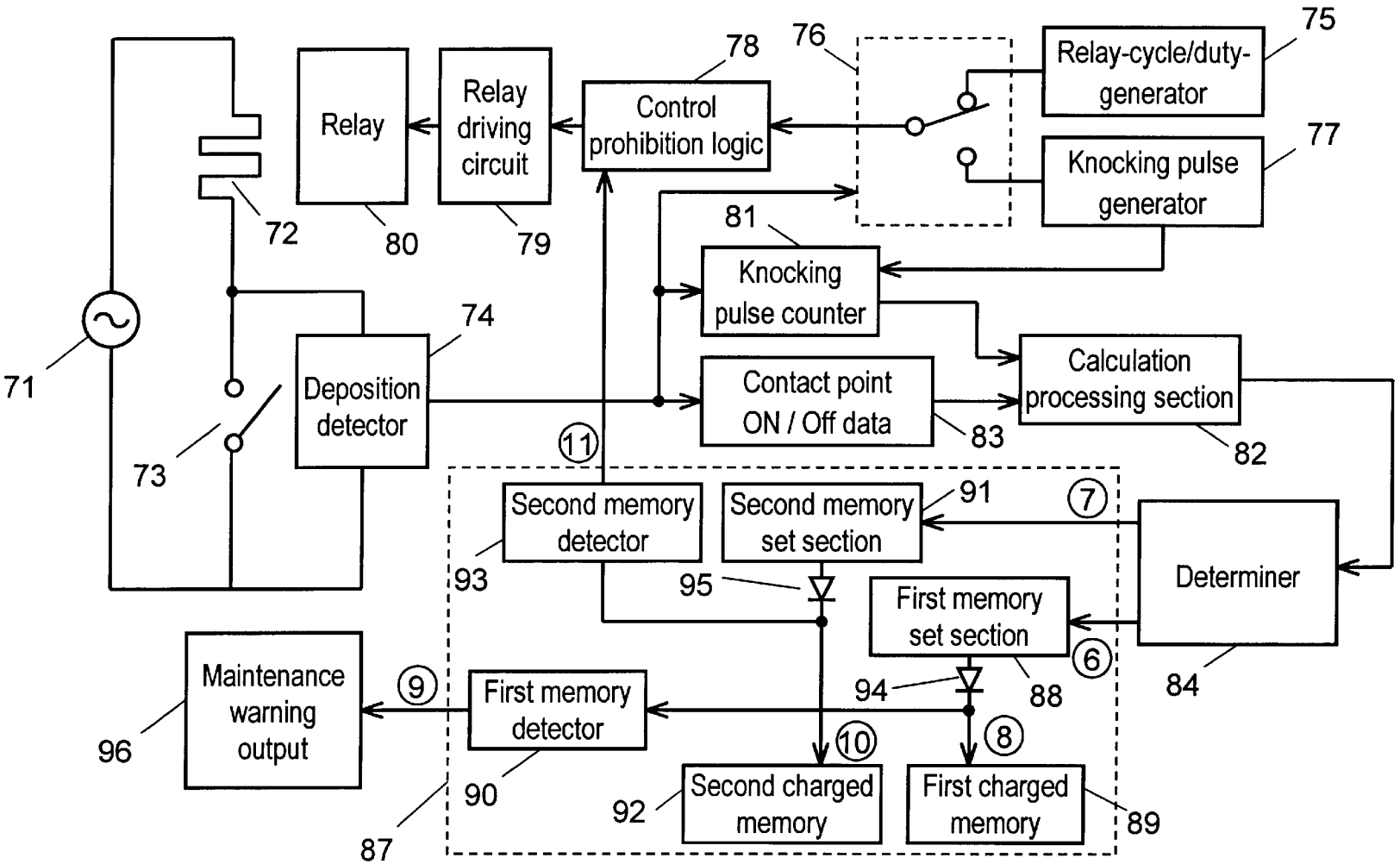
FIG. 8 is a block diagram of a memory in accordance with the exemplary embodiment.
Figure 9:
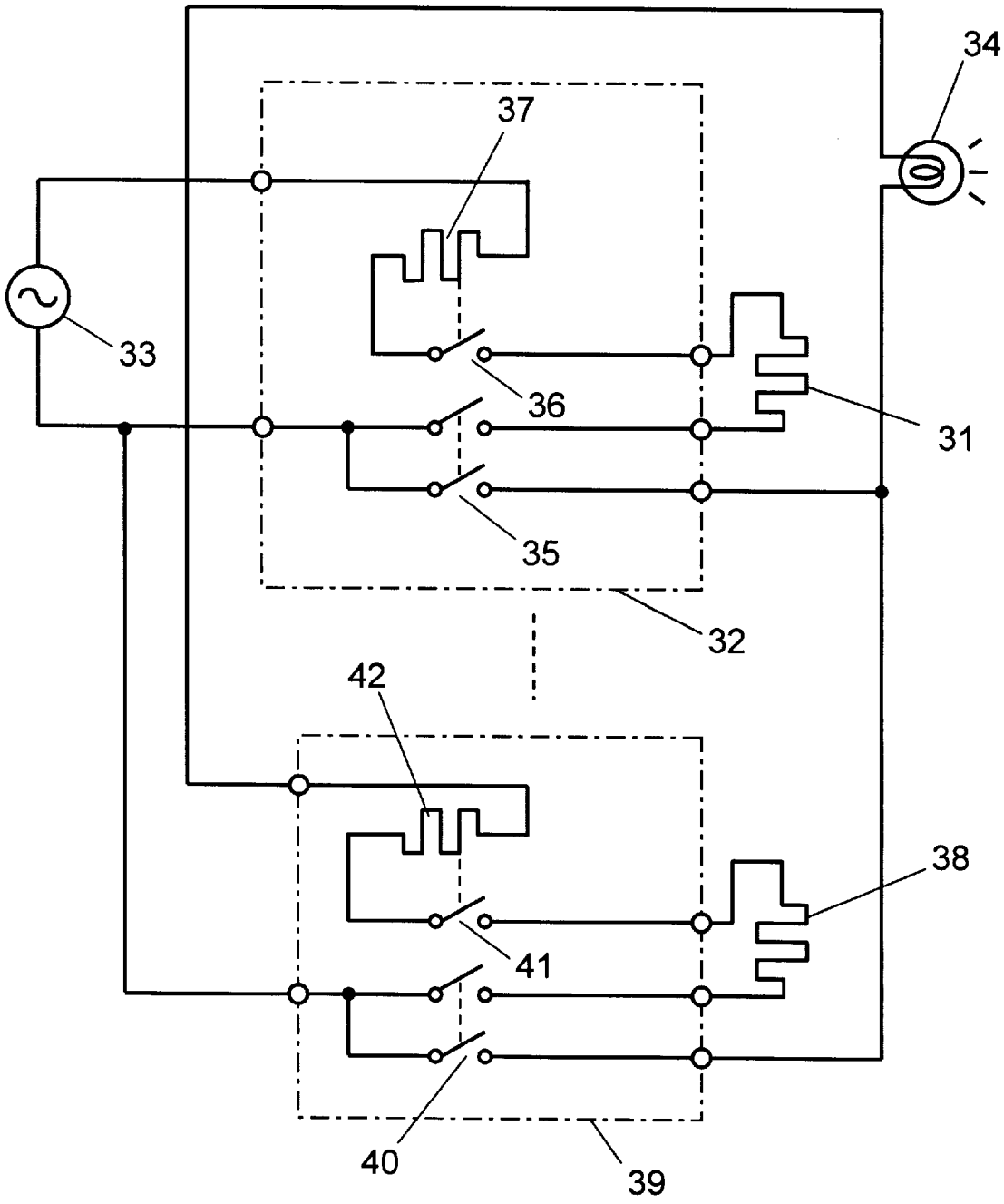
FIG. 9 is a circuit diagram of a conventional electric cooker.

The memory operation, i.e. the status of issuing the maintenance warning or that of the forcible halt can be maintained even if the power is discontinued by error or a power failure occurs, is described with reference to the block diagram in FIG. 8.

The description previously described is omitted here, and the memory operation, which can maintain the status of the maintenance warning or the forcible halt after the power is restored, is focused here.

Let assume that the maintenance warning ⑥ is output from determiner 84, then first memory SET section 88 supplies charging signal ⑧ to first charged memory 89 comprising a capacitor and the like. The maintenance warning signal is stored through charging the capacitor. First memory detector 90 comprising a comparator with high input impedance would detect the status stored in the capacitor for a long time even the power is discontinued. When the power is restored, if first charged memory 89 still have electric charges therein, first memory detector 90 issues signal ⑨ so that the maintenance warning 96 can be supplied. In the same manner, let assume that forcible halt signal ⑦ is issued, then second memory SET section 91 supplies charging signal ⑩ to second charged memory 92. When the power is restored and if second charged memory 92 still have electric charges therein, second memory detector 93 issues signal ⑪ and triggers a forcible prohibition logic that forcibly halts the electric cooker. The memory function can be thus realized.

First diode 94 and second diode 95 prevent the capacitors of first and second memory SET sections 88 and 91 from being discharged.

INDUSTRIAL APPLICABILITY

The embodiment discussed above proves that the electric cooker of the present invention allows a plurality of heaters to ON/OFF their contact points near the zero potential, and has functions of detecting deposition on the contact points and removing the deposition by itself. The safety of the electric cooker is thus substantially improved.

The contact point is defined to ON/OFF near the zero potential alternately at the transitin point from/to positive area to/from negative area, which reduces chances of forming deposition on the contact points. The service life of relay's contact point is thus substantially extended. The ON/OFF control of contact points of plural relays and the control of heat adjustment can be practiced free from errors for a long time. As a result, the electric cooker having high reliability, stable performance and being free from maintenance can be achieved.

When a low heat is selected, a particular section of heat adjustment is controlled with a short cycle so that stewed dish can be cooked with less heat loss. When the heat adjuster moves to another area where the low heat is no longer needed, or turns to OFF for completing the cooking, the low heat mode is automatically reset, which effects useful benefit to users.

Computation using ON/OFF data of the contact point and a number of short pulses counted when the deposition is detected, can predict a life end of the contact point. Based on this result, a warning is issued or a cooker is forcibly halted so that an abrupt failure or a dangerous situation can be prevented.

These determined information can be stored in a memory function which is defined simply and inexpensively so that the information can survive a power failure or a power discontinuation. The safety of the cooker is thus advantageously secured with ease.

What is claimed is:

1. An electric cooker comprising:

a plurality of heaters;

a plurality of relays for controlling said heaters, each relay having a contact point;

a deposition detector for detecting deposition on the contact point;

a zero volt detector for detecting a zero potential of a power source;

a heat adjuster for adjusting heat of said heaters;

a controller for controlling said relay based on a signal from said heat adjuster and changing a control signal of said relay to a short pulse signal based on a signal detecting the deposition; and wherein said controller controls said respective contact points based on a signal from said zero volt detector for practicing ON/OFF of the contact point near zero potential of the power source, and said controller controls the ON/OFF position of the contact point according to alternative changes of a transition point from/to a positive area to/from a negative area of the power source.

2. The electric cooker as defined in claim 1 further comprising:

an automatic cycle switch for switching a plurality of control cycles in a heat adjustment process; and a manual low heat selector effective only a predetermined part of said heat adjuster, wherein said low heat selector includes an automatic canceler for canceling automatically a low heat mode when said heat adjuster moves to another position.

3. The electric cooker as defined in claim 1 further comprising:

a calculation processing section for processing count data by a counter for counting a number of short pulse signals generated by said controller and an ON/OFF data from said deposition detector; and a determiner for one of issuing a warning and halting forcibly said cooker based on a calculation result in said calculation processing section.

4. The electric cooker as defined in claim 1 further comprising a memory utilizing electric charges of a forcible halt signal and a warning signal generated from a determiner, the electric charges being held in a capacitor.

5. The electric cooker as defined in claim 1 wherein said plurality of relays are disposed together and replaceably.

* * * * *